US010858714B2

(12) United States Patent
Thomas

(10) Patent No.: US 10,858,714 B2
(45) Date of Patent: Dec. 8, 2020

(54) BLOWING LANCE TIP

(71) Applicant: SOUDOBEAM SA, Sprimont (BE)

(72) Inventor: Jean-Philippe Thomas, Sprimont (BE)

(73) Assignee: SOUDOBEAM SA, Sprimont (BE)

( * ) Notice: Subject to any disclaimer, the term of this patent is extended or adjusted under 35 U.S.C. 154(b) by 127 days.

(21) Appl. No.: 16/093,608

(22) PCT Filed: Apr. 13, 2017

(86) PCT No.: PCT/EP2017/058973
§ 371 (c)(1),
(2) Date: Oct. 12, 2018

(87) PCT Pub. No.: WO2017/178606
PCT Pub. Date: Oct. 19, 2017

(65) Prior Publication Data

US 2019/0119765 A1 Apr. 25, 2019

(30) Foreign Application Priority Data

Apr. 15, 2016 (BE) ..... 2016/5263

(51) Int. Cl.
*C21C 5/46* (2006.01)

(52) U.S. Cl.
CPC .... *C21C 5/4606* (2013.01); *C21C 2005/4626* (2013.01)

(58) Field of Classification Search
CPC ..... C21C 5/4606; C21C 2005/4626
USPC ..... 266/225, 270, 268; 239/132.3, 124, 132, 239/548
See application file for complete search history.

(56) References Cited

U.S. PATENT DOCUMENTS 6,217,824 B1 * 4/2001 Leczo ..... C21C 5/4606 266/225
6,234,406 B1 * 5/2001 Thomas ..... C21C 5/4646 239/132
6,849,228 B2 * 2/2005 Thomas ..... C21C 5/4606 266/225

(Continued)

FOREIGN PATENT DOCUMENTS

DE 19506718 * 8/1996 ..... C21C 5/4606
DE 102010034315 A1 8/2011
WO 0222892 A1 3/2002

OTHER PUBLICATIONS

International Search Report dated Aug. 2, 2017, issued in corresponding International Application No. PCT/EP2017/058973, filed Apr. 13, 2017, 14 pages.

*Primary Examiner* — Scott R Kastler
*Assistant Examiner* — Michael Aboagye
(74) *Attorney, Agent, or Firm* — Christensen O'Connor Johnson Kindness PLLC

(57) ABSTRACT

A blowing lance tip includes a central stirring gas-supply tube, an inner coolant-inlet tube ending, at one end thereof facing the bath, in a second front wall and having a central opening, an outer coolant-outlet tube, a heat exchange space, and a stirring gas-outlet pipe leading from each opening in the front wall, wherein the second front wall has, at the central opening, an edge which is curved in axial cross-section such that a height (H3) is defined between a leading face of said edge and the third front wall, and such that, in the heat exchange space, a predetermined minimum height (H1) is present on the side facing the central opening.

16 Claims, 3 Drawing Sheets

(56) References Cited

U.S. PATENT DOCUMENTS

| | | | | |
|---|---|---|---|---|
| 9,828,646 | B2 * | 11/2017 | Dengel | C21C 7/00 |
| 2007/0246869 | A1 | 10/2007 | Rymarchyk et al. | |
| 2012/0211930 | A1 | 8/2012 | Bagheri et al. | |

* cited by examiner

BLOWING LANCE TIP

BACKGROUND

The present invention relates to a blowing lance tip, intended for bath stirring, comprising a central tube for supplying stirring gas, closed at an end turned towards the bath by a first front wall provided with at least two openings, an internal tube forming with the central tube a first annular cavity for the passage of a cooling liquid and ending at one end turned towards the bath by a second front wall, called a separator, having a central opening and one passage orifice per opening provided in said first front wall, an external tube forming with the internal tube a second annular cavity for the passage of the cooling liquid and closed at an end turned towards the bath by a third front wall having one outlet orifice per opening provided in said first front wall and having an internal surface comprising a central tapered area which is directed towards said central opening and which has a curved envelope surface in axial section, a heat exchange space which is located between, on the one hand, said second front wall and said internal surface of the third front wall and, on the other hand, said central opening and said second annular cavity, and in which the cooling liquid flows, and an outlet conduit for the stirring gas, called an injector, leaving each opening in said first front wall and going as far as said corresponding outlet orifice passing through said corresponding passage orifice in a cooling liquid-tight manner.

Throughout the description, the terms "tapered central area which is directed towards said central opening and which has a curved envelope surface in axial section" will be, for simplicity, occasionally only expressed by the term "central depression".

The blowing lance tip as described in the present invention is used, among others, in oxygen converters for the creation of steel (BOF Basic Oxygen Furnace, AOD Argon Oxygen Decarburization). The converters allow steel to be obtained by injecting oxygen into a bath of molten iron in order to burn the carbon contained within. The basic principle in the field of blowing oxygen into converters (for example, LD (for Linz-Donawitz)) is to drive 3 to 6 jets of oxygen arranged in a ring onto a bath of molten iron. The lance which allows the formation of these oxygen jets is then placed at a distance of 1 to 5 metres above a bath of molten iron whose temperature may reach 1700° C.

The temperature of the lance tip may then increase by up to 400° C. and have to remain in that environment for approximately 20 minutes. The tip is then withdrawn and returned to room temperature, i.e. 20° C. These pressures damage the lance tips used for steelmaking converter baths and typically, the service life of these is reduced following the significant pressures to which they are subjected, over a significant number of successive uses.

To improve the cooling of the lance tips, heat exchange spaces have been developed so that a cooling liquid can move along the internal wall turned towards the bath of the lance tip. When a cooling liquid, generally water, moves along the front wall, the calories of the metal forming this wall are transferred to this cooling liquid. In this way, the temperature of the lance tip is uniform over the entirety of the tip, and is no longer particularly elevated only where the walls are exposed to the bath.

Poor circulation of the cooling liquid may also cause a local rise of the temperature of the cooling liquid. Consequently, the liquid may vaporise locally under the thermal stress. This results in the formation of cavities filled with gas trapped within the cooling liquid. This formation of gaseous cavities in a liquid is known as cavitation phenomenon. These cavitation phenomena then cause a reduction in the effectiveness of the front wall cooling as the thermal exchange between a gaseous phase and a solid phase is significantly worse than between a liquid phase and a solid phase. If the cooling is not uniform across the entirety of the wall exposed to the thermal variations, mechanical stresses appear between the different areas of this wall. This inhomogeneous distribution of the temperature consequently causes a reduction in the longevity of the lance tip. In fact, the latter has, after several working cycles, disturbances which considerably limit its service life.

Documents U.S. Pat. No. 4,432,534 and WO9623082 have, for example, lance tips designed to allow a cooling liquid to flow at high speed along the internal surface of the front wall, this same front wall having a minor central depression in order to maximise said flow.

Document EP0340207 in turn provides a significant depression in the central area of the lance tip onto which secondary cooling liquid jets are directed, causing a whirlpool movement in the flow of liquid.

Document WO0222892 attempts to further improve the flow of the cooling liquid in the thermal exchange space of the lance tip by developing a central depression in the surface turned towards the bath having a definite ratio between the height and base of this depression. This ratio allows the heat exchange space to have a section for the substantially constant passage of the cooling liquid in order to obtain a passage speed of the cooling liquid through this space which is approximately constant.

Document DE 19506718 describes a blowing lance tip used in or above molten steel and having a cooling system based on the difference in roughness between the two walls of the heat exchange space, namely the separator and the internal surface of the third front wall. The ratio between the difference in roughness and the minimum radius of curvature of the surface exposed to the molten steel must remain constant in order to ensure proper cooling.

When the cooling of the lance tip is not effective, aside from the appearance of mechanical stresses, it has also been observed that an erosion phenomenon of the front wall appears around the outlet orifice for the stirring gas conduits.

In the following description, the expression "stirring gas outlet conduit" will, for simplicity, sometimes be expressed only by the term injector.

The diameter of the injector outlet orifices tends to increase following erosion at their edges. This increase in diameter distorts the oxygen jets, which causes, alongside the destruction of the lance tip, dispersal of these jets and consequently a reduction of their effectiveness. The carbon oxidation reaction is, in fact, boosted by the depth of penetration of the jets into the bath and by their stirring. The lance tips being placed at a distance of 1 to 5 m above the molten metal bath, in order to be effective, the jets must have a consistent profile over as long a distance as possible. The reaction yield is then reduced when these jets are dispersed as they do not penetrate as deeply into the molten metal bath. Consequently, the reaction yield in the bath is not optimal, and also presents significant variability of the service life of a lance tip.

Effective cooling is thus important for the proper operating of the lance tips, since it advantageously increases their service life but also ensures better stability of reaction yield throughout their service life and this minimises erosion at the edges of the front wall. However, such cooling is also very difficult to implement, in the extreme conditions encountered during the use of the lance tips.

While the documents described above contribute to the improvement of the tip cooling technique, unfortunately they still do not offer a sufficient service life nor a reaction yield in the bath which will be stable throughout this service life.

SUMMARY

The object of the present invention is to overcome the disadvantages of the prior art by providing a lance tip which is simple to manufacture and ensures an improved, stable reaction yield in the molten metal bath throughout the service life of the lance tip.

To solve this problem, a lance tip according to the invention is provided, as indicated above, in which the separator has an edge in axial section at the central opening which is curved such that a height H3 is defined between a front of said edge and said internal surface of the third front wall and, in the heat exchange space, a minimum predetermined height H1 is present on the side of said central opening, such that the H1/H3 ratio is between 5% and 80%, advantageously between 5% and 75%, preferably between 5% and 70%, preferentially between 5% and 65%, particularly advantageously between 5% and 60%, preferably between 10% and 60%, advantageously between 15% and 60%, preferably between 20% and 60%, preferentially between 25 and 60%, particularly advantageously between 25% and 55%, preferably between 30% and 55%.

Contrary to the documents cited above, it has been discovered that the flow of the cooling liquid could be surprisingly improved by simultaneously working on the separator, in particular its edge at the central opening, and on its position with respect to the third front wall.

In fact, on the one hand, the separator edge at the central opening, thanks to its curved axial section, allows the cooling liquid, arriving from the first annular cavity, to carry out a progressive rotation between this curved edge and the central depression of the internal surface of the third front wall to arrive in the heat exchange space undisturbed.

The injectors in the lance tip form obstacles in the path of the cooling liquid, firstly between the first and the second front walls and then in the heat exchange space between the second and the third front walls. "Calming" of the cooling liquid therefore takes place after bypassing the first obstacle, formed by the injectors between the first and the second front walls. This role is met according to the present invention by the separator edge which is curved in axial section and which allows a central opening to be formed and in the heat exchange space of the maximised cooling liquid passage sections.

Furthermore, this curved edge in axial section of the separator allows energy loss to be minimised in the cooling liquid flow which improves the acceleration of the liquid during its passage between the curved edge of the separator and the tapered central area of the internal surface of the third front wall, before its arrival in the heat exchange space. This first acceleration is regulated by the cooling liquid passage section between the separator edge and the central depression. In the volume contained in the cone passing through the revolution axes of the injectors, H1 is the minimum height of the water passage along the internal surface of the third front wall in the heat exchange space. This first acceleration allows the cooling of the central part of the lance tip to be improved, which is the part where the metal/liquid exchange surface is the least substantial and thus the area is the most difficult to cool.

The term "passage section" according to the present invention is understood to be a section taken perpendicular to the flow direction of the cooling liquid.

On the other hand, the positioning of the separator with respect to the third front wall allows a heat exchange space to be formed which has a predetermined height which regulates the acceleration of the cooling liquid. The separator according to the present invention is substantially flat and substantially parallel to the third front wall, thus ensuring a flow of cooling liquid with reduced turbulence and cavitation phenomenon.

The lance tip according to the present invention thus allows both the path of the cooling liquid to be maximised, which minimises turbulence, and the acceleration of this liquid to be improved in order to effectively cool the wall exposed to thermal stresses. Consequently, the service life of the lance tip according to the present invention is considerably increased and the erosion of the edges of the injector outlets is minimised in such a way that the reaction yield in the bath is improved and remains stable throughout the service life of the lance tip. In fact, proper cooling reduces the erosion of the edges of the outlet for the stirring gas, which allows more coherent jets to be obtained at the injector outlets. These more coherent jets penetrate more deeply into the molten metal bath and ensure better stirring thereof, thus ensuring an improvement of the reaction yield in the bath. Furthermore, the gases and dust emitted from the surface of the bath and rising towards the lance tip have a lesser impact on the degradation of the tip when the cooling thereof is improved, as for the tip of the present invention. Consequently, the service life of the tip according to the present invention is increased.

In another particular embodiment, the lance tip according to the present invention has a predetermined external diameter $D_{ext}$ and said separator edge is defined by a thickness e1 so the ratio e1/$D_{ext}$ is between 3% and 30%, preferably between 4% and 25%, advantageously between 5% and 20%, preferentially between 5% and 15%.

The thickness e1 of the separator edge is the distance, taken parallel to the revolution axis of the injectors, between the surface turned towards the first front wall and the surface turned towards the separator bath. This particular separator edge thickness on the one hand allows the rotation of the cooling liquid around the separator edge which faces the central depression to be further improved. On the other hand, the particular separator edge thickness advantageously reduces the loss of energy when the cooling liquid is flowing. The reduction of energy loss leads to the maintenance of the acceleration of the liquid and thus the optimisation of the cooling of the tip.

Advantageously, the lance tip separator has a substantially sinusoidal surface, turned towards the bath.

The term "sinusoidal surface" is understood to be a surface which forms an wavy curve, which, for example, has a convex part between two concave parts. The separator having a sinusoidal surface has, consequently, a convex part between two concave parts with respect to the third front wall. A minimum thickness is consequently situated between two maximum thicknesses of the separator.

This sinusoidal surface has the advantage of offering an improved passage section in the heat exchange space to the cooling liquid. In fact, as mentioned above, a first acceleration of the cooling liquid occurs before entry into the heat exchange space. The sinusoidal surface of the separator leads to an increase of the passage section for the cooling liquid substantially in the centre of the separator. In fact, the injectors, which substantially traverse the separator in its centre, block the heat exchange space. It is thus in this place that the separator is made concave (having a bulge towards the interior) to make room for the passage of the cooling liquid. The sinusoidal form of the surface turned towards the separator bath thus allows the energy loss to be reduced during the second bypass of the injectors between the separator and the internal surface of the third front wall. This sinusoidal surface is advantageous for the proper cooling of the wall exposed to the bath of molten iron.

Preferably, said substantially sinusoidal surface of said separator turned towards the bath is such that the heat exchange space has a maximum height substantially in the centre of said separator.

Preferably, the lance tip according to the invention has a pillar comprising a first end located opposite the bath and a second end turned towards the bath linked to the central area of the third front wall.

On the one hand, this pillar allows the circulation of the cooling liquid to be improved when it plunges into the central opening. In fact, the central opening may be a collision area and the pillar present in the centre of this central opening allows, consequently, the minimisation of turbulence. The liquid will then move along the pillar before arriving in the heat exchange space.

In addition, this pillar advantageously formed of a material of good thermal conductivity, such as copper, ensures a good transfer of the calories accumulated in the front wall exposed to the bath towards the cooling liquid. This calorie transfer phenomenon is known as "cold sink". The heat transferred by the pillar then diffuses towards the cooling liquid moving around it.

In a particularly advantageous manner, the pillar has a thinned part between said first and second ends linked to the central area which has a predetermined length L1 and an axial section decreasing in a continuous way towards the central area, such that the pillar forms a continuous curved surface with the central area of the internal surface of the third front wall.

According to the present invention, the term "continuous curved surface" is understood to be a surface which has a "continuity of curves", preferably a "continuity of tangents".

The term "continuity of tangents" according to the present invention is understood to mean, in the axial section of the pillar, the curve of the thinned part of the pillar and the curve of the tapered central area of the third front wall have equal tangents at the end of their joint end, i.e. at their connection (second end of the pillar). The tangents are the first derivatives of the curves at their joint end.

A second level of "continuity of curves" may optionally be a "curvature continuity" which means that the radii of curvature of the two curves (thinned part of the pillar and tapered central area of the internal surface of the third front wall) are equal at their joint end, i.e. at their connection (second end of the pillar). In other terms, the curves of the thinned part of the pillar and the tapered central area of the internal surface of the third front wall have the same direction at their connection and also have the same radius at this point. The radii of curvature are the second derivatives of the curves at their joint end, i.e. at their connection at the second end of the pillar.

The cooling liquid arriving in the peripheral part of the tip (annular cavity) converges in the central opening where it carries out a rotation of approximately 180° between the pillar and the edge of the separator before arriving in the heat exchange space, for example frontal. The presence of this pillar having a particular geometry allows, on the one hand, the flow of the cooling liquid traversing the central opening where it passes between the thinned part of the pillar and the edge of the separator to be maximised, and, on the other hand, the cooling liquid to be accelerated before its arrival in the heat exchange space. In fact, the edge of the separator according to the present invention has a positive fit with the central thinned part of the pillar advantageously present in the centre of the central opening. This positive fit between these two elements is particularly advantageous for the accompaniment of the cooling liquid during its rotation of approximately 180° in the central opening thus allowing the turbulence in the liquid to be reduced, to "calm" it and to maintain good contact with the pillar serving as "cold sink" and then with the third front wall. In addition, this geometry also allows the acceleration of the cooling liquid before its passage into the heat exchange space.

Advantageously, in the lance tip according to the present invention, the pillar has a second part of predetermined length L2 joining said thinned part and said first end, said second end having a circular transversal section defined by a predetermined diameter D2, constant along the length L2 such that the ratio $D2/D_{ext}$, is between 2% and 30%, advantageously between 7.5% and 17.5%, preferably between 10% and 15% of said external diameter ($D_{ext}$) of the lance tip.

In this particular embodiment of the lance tip, given its diameter, the pillar may be considered as "massive" in view of the volume it occupies in the tip. This massive pillar composed of a material of good thermal conductivity, such as copper, allows a good transfer of the calories accumulated in the front wall exposed to the bath towards the cooling liquid to be ensured, thus improving the "cold sink" phenomenon. The heat transferred by the pillar then diffuses towards the cooling liquid, moving around it, and whose metal/liquid heat exchange surface is increased thanks to the thinned part having a curved profile. The heat is, therefore, better distributed within the lance tip, which more particularly ensures proper cooling of the area most exposed to extreme temperatures, i.e. the centre of the third front wall. The lance tip according to this embodiment thus results in a supplementary improvement of the cooling of the tip.

Advantageously, said thinned part I of the pillar has a minimum predetermined diameter D3 at its second end and said central area has a height h and a base b, such that the ratio h/(b-D3) is between 20% and 120%, preferably between 20% and 110%, advantageously between 30% and 110%, preferentially between 30% and 100%, in particular between 40% and 100%, particularly advantageously between 40% and 90%, preferably between 45% and 85%, advantageously between 50% and 80%.

When no pillar is present at the top of the tapered central area, D3 is zero and h/(b-D3)=h/b.

The heat exchange surface is then increased with respect to a same surface of the heat front rising from the bath, and this without generating either whirlpool or cavitation in the liquid. Furthermore, the liquid passage section in the heat exchange space is such that the cooling liquid has an adequate velocity profile, so the cooling of the front wall exposed to the bath is further improved.

Preferably, the lance tip according to the present invention is characterised by a distance R for the cooling liquid passage, taken perpendicularly to the longitudinal axis L of the tip in the central opening. When no pillar is present in the central opening, this passage distance is then labelled $R_1$ and is measured between the front of the separator and the longitudinal axis of the tip, and thus corresponds to the minimum radius of the central opening. When a pillar is present in the central opening, the liquid passage distance R is then measured between the front of the separator and the external surface of a thinned part I of the pillar, the distance is then labelled $R_2$. In the two scenarios, this passage distance R is such that the ratio R/H3 is between 20% and 150%, preferably between 30% and 140%, advantageously between 30% and 130%, preferentially between 40% and 130%, particularly advantageously between 50% and 130%, preferably between 60% and 120%, advantageously between 60% and 110%, preferably between 70% and 110% with R corresponding to R1 in the absence of a pillar or corresponding to R2 in the presence of a pillar.

This passage distance, particularly for the cooling liquid, allows the flow of the cooling liquid which will converge in the central opening before reaching the heat exchange space to be further improved. The liquid passage distance in the central opening in combination with the above-mentioned features of the tip allow the flow to be further improved by improving the reduction of disturbances and the acceleration of the cooling liquid.

Advantageously, said separator has a substantially sinusoidal surface turned towards said first front wall.

In a particular embodiment, a deflector is substantially present in the centre of said central tube for supplying stirring gas of the lance tip according to the present invention.

This deflector allows the gas leaving the central conduit to be appropriately derived for engaging in the stirring gas outlet conduits.

In a particularly advantageous embodiment of the device according to the invention, said stirring gas outlet conduits have revolution axes obliquely arranged with respect to a longitudinal axis of the lance tip.

In a particular embodiment, the above elements of the tip are produced separately and fixed in the mutual binding area by high energy welding, preferably electron beam welding.

The aforementioned tip is produced from several tip elements each being composed of a material chosen according the function to be performed. These elements are then fixed between them by high energy welding, preferably by electron beam. This type of welding ensures the copper-steel connections are easy to achieve and have a good liquid seal and this in spite of the fatigue stresses due to the successive thermal cycles to which the tip is subjected.

Other forms of the device according to the invention are shown in the appended claims.

BRIEF DESCRIPTION OF THE DRAWINGS

Other details and advantages of the invention will become clearer from the following description, which is not limiting, and by referring to the appended drawings.

In the figures, similar or identical elements bear the same references.

DETAILED DESCRIPTION

Figure 1:
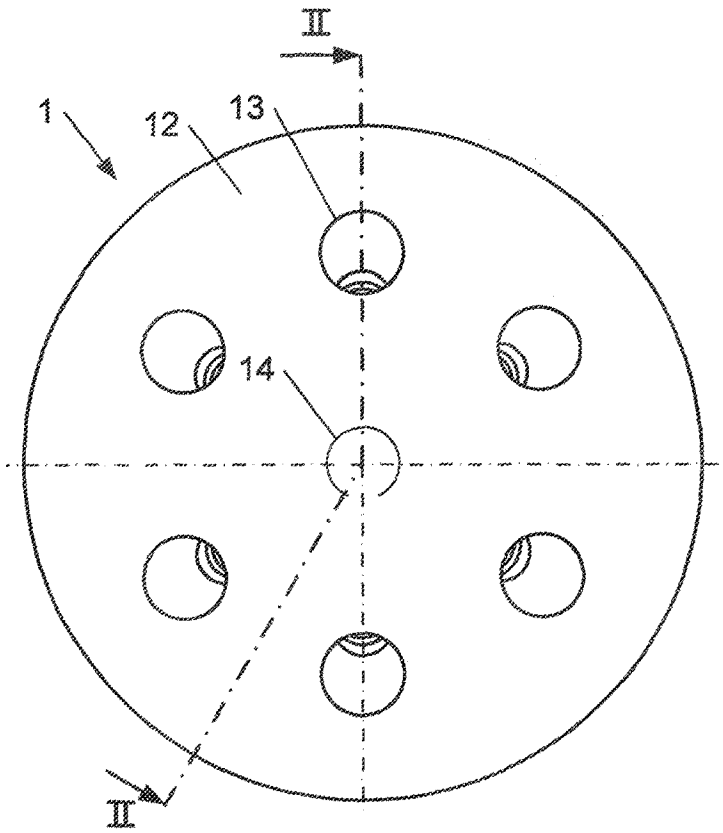
FIG. 1 is a front view of the lance tip.

FIG. 1 shows the third front wall 12 of the lance tip 1 which is turned towards the bath. According to this embodiment, the lance tip 1 has six stirring gas outlet orifices 13 placed in a ring around a central area 14 of the third front wall 12.

Figure 2:
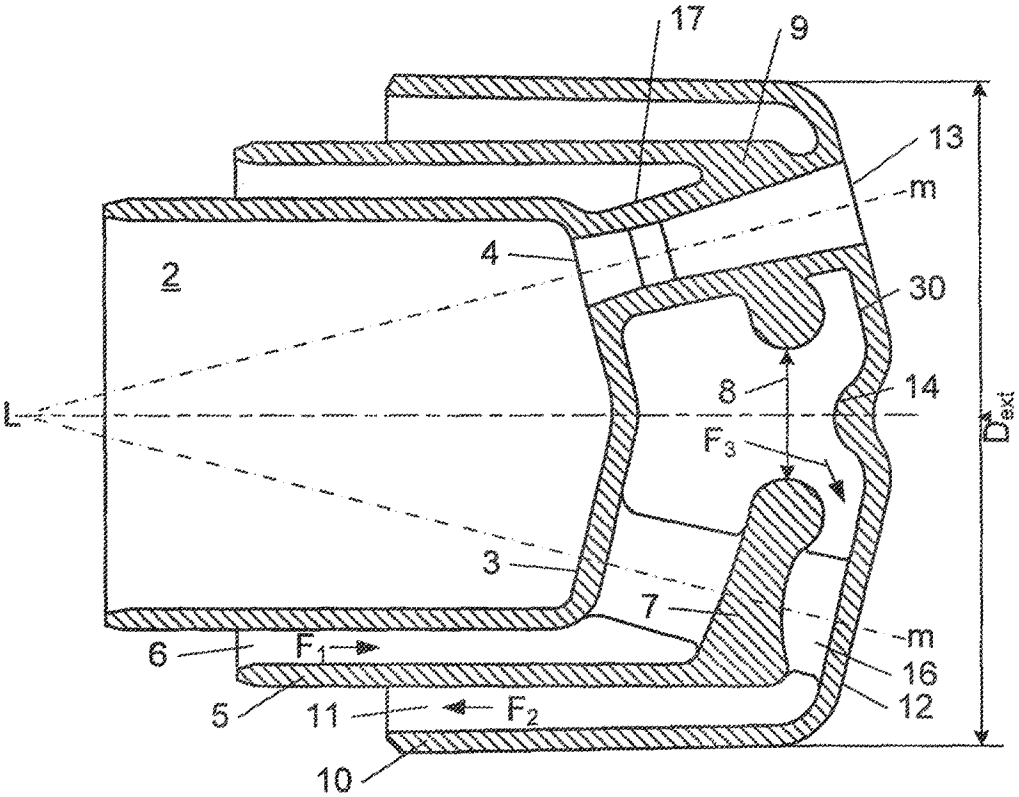
FIG. 2 shows a sectional view following the line II-II of FIG. 1, in a particular embodiment of the lance tip according to the invention.

FIG. 2 shows the lance tip according to the present invention wherein the stirring gas is supplied via the central tube 2. This central tube 2 is closed by a front wall 3 directed towards the bath provided with at least two openings 4.

An internal tube 5 is arranged in a coaxial manner around the central tube 2 in order to form an annular cavity 6 between them, for supplying the cooling liquid in the direction of arrow $F_1$. This internal tube 5 is ended by a front wall 7 which is known as a separator. This front wall 7 is provided with a central opening 8 and an orifice 9 in alignment with each opening 4 in the central tube 2. The separator 7 according to the present invention has a particular geometry and arrangement with respect to the third front wall 12 which will be outlined below.

An external tube 10 is arranged coaxially around the internal tube 5. This external tube forms an annular cavity 11 with the internal tube 5, which is used for the exit of the cooling liquid in the direction of arrow $F_2$. This external tube is closed by a front wall 12 which faces the bath to be stirred and comprises an internal surface 30. As shown in FIG. 2, the internal surface 30 of the third front wall 12 is provided with a tapered central area 14 which is directed towards the central opening 8 and which has a curved envelope surface in axial section.

The front wall 12 is also provided with an outlet orifice 13 in alignment with each opening 4 provided in the front wall 3 and with each passage outlet 9 provided in the front wall 7. In each of these aligned outlets and openings, an outlet conduit 17 is arranged for the ejection of stirring gas outside the lance tip. The revolution axes m of the conduits 17 are advantageously obliquely arranged with respect to the longitudinal axis L of the lance tip.

The cooling of this front wall 12 is ensured by the circulation of the cooling liquid in the heat exchange space 16 which is situated between the separator 7 and the internal surface 30 of the front wall 12. In the illustrated embodiment, the cooling liquid coming from the cavity 6 passes through the central opening 8 into the heat exchange area 16 following arrow $F_3$. The liquid then flows outwardly in the direction of arrow $F_2$, namely towards cavity 11.

Figure 3:
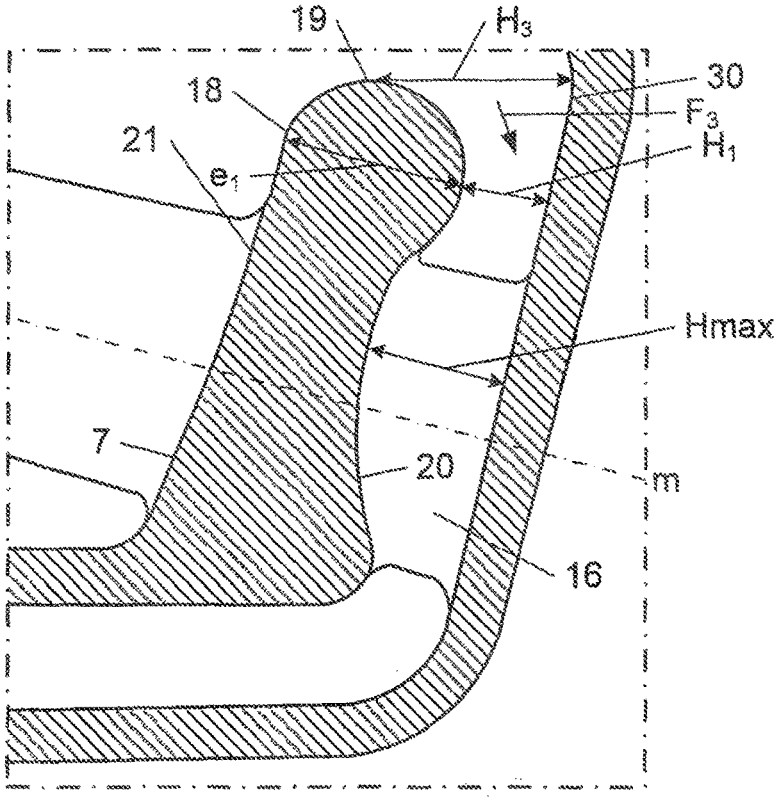
FIG. 3 represents a detail of a lance tip according to the invention, to illustrate the characterising part of the invention.

In FIG. 3, the separator 7 according to the present invention is substantially flat and substantially parallel to the internal surface 30 of the third front wall 12. This separator 7 has a central opening 8, a curved axial section edge 18. A minimum diameter of the central opening 8 may then be measured from the front 19 of the edge 18 of the separator 7. The tangent passing by this front 19 and parallel to the longitudinal axis L of the lance tip allows the smallest diameter of the central opening 8 to be measured.

The height taken along the tangent passing by the front 19 and parallel to the longitudinal axis L of the lance tip and measured between said front 19, and the internal surface 30 of the third front wall 12 corresponds to the height H3 as indicated in FIG. 3. The height H1 is, in turn, measured, parallel to the revolution axis m of the injectors 17, between the surface turned towards the bath 20 of the separator 7 and the internal surface 30 of the third front wall 12, on the side of the central opening 8. This height H1 defines a minimum passage height for the cooling liquid in the heat exchange space 16 at the central opening 8. In the volume contained in the cone passing through the revolution axes of the injectors, H1 is the minimum height of the water passage along the internal surface of the third front wall in the heat exchange space. According to the present invention, the ratio $H_1/H_3$ is advantageously between 30% and 55%.

The curved axial section of the edge 18 of the separator 7 advantageously accompanies the cooling liquid during its convergence in the central opening 8. In addition, as shown in FIG. 3, the edge 18 of the separator 7 has a positive fit with the tapered central area 14 of the internal surface 30 of the third front wall 12. The liquid is therefore kept in contact with the internal surface of the third front wall 12, which is the most exposed to the thermal stresses. Consequently, a flow of cooling liquid with reduced disturbances and cavitation phenomena may be obtained and maintained along its path. The cooling liquid thus "calmed" may then calmly bypass the obstacles which the injectors 17 form in the heat exchange space 16 before leaving the tip by the second annular cavity 11 following arrow $F_2$.

The external diameter $D_{ext}$ of the lance tip 1 according to the present invention corresponds to the diameter measured between the external surfaces of the external tube 10, as represented in FIG. 2.

Generally, a thickness of the separator 7 is measured between the surface 21 turned towards the first front wall 3 and the surface turned towards the bath 20 of the separator 7.

The thickness e1 of the edge 18 of the separator 7 is therefore measured parallel to the revolution axis m of the injector 17 in the continuity of the minimum height H1 of the heat exchange space 16 at the central opening 8. This thickness allows the separator to occupy a consistent volume in the lance tip and allows, in combination with the curve section of the edge 18, a flow of the cooling liquid with reduced disturbances and good acceleration to be maintained. Preferably the ratio $e1/D_{ext}$ is between 5% and 15%, In a particular embodiment of the lance tip represented in FIG. 3, the surface turned towards the bath 20 of the separator 7 is substantially sinusoidal. In the event of the surface turned towards the bath 20 of the separator 7 having a substantially sinusoidal form, the maximum thickness e1 is measured between the surface 21 turned towards the first front wall 3 and the tangent passing by the minimum of the concave part of the surface turned towards the bath 20. On the contrary, a minimum thickness is measured between the surface 21 turned towards the first front wall 3 and the tangent passing by the maximum of the convex part of the surface turned towards the bath 20.

This means that the separator 7 also has its thickness e1 at the central opening 8, a substantially minimum thickness in its centre so the heat exchange space 16 has a substantially maximum height $H_{max}$ in the centre of the separator 7. The object of this maximum height $H_{max}$ is to allow more space for the cooling liquid during its passage in the region of the injectors 17 in the heat exchange space 16.

Figure 4:
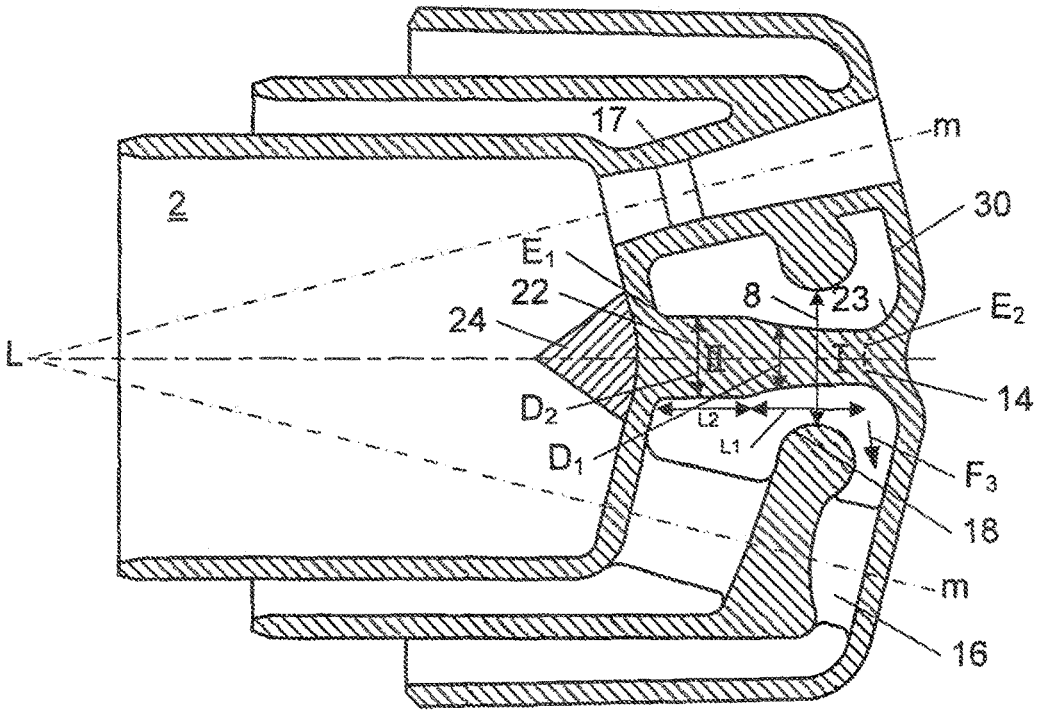
FIG. 4 represents a view similar to that of FIG. 2, of a variation of a blowing lance tip according to the invention.

FIG. 4 represents a particular embodiment of the lance tip according to the present invention. In this embodiment, a central pillar 22 of particular configuration is present in the centre of the central opening 8.

The pillar 22 has a first end E1 on the side of the first front wall 3 and a second end E2 linked to the central area 14 of the internal surface 30 of the third front wall 12. This pillar preferably has a thinner part I between the first end E1 and the second end E2 which allows a continuous curved surface 23 to be formed with the tapered central area 14 of the internal surface 30 of the third front wall 12. In this way, the cooling liquid coming from the first annular cavity 6 following arrow $F_1$ moves along the upper face 21 of the separator 7 where it shall bypass the injectors which form a first obstacle in the path of the liquid and then converge in the central opening 8. The pillar 22 present in the centre of this central opening 8 then allows the cooling liquid to be guided towards the internal surface 30 of the third front wall 12 or the thinned part I of the pillar ensures the passage of the liquid between this pillar 22 and the edge 18 of the separator 7, following arrow $F_3$. Furthermore, the connection of the tapered central area 14 of the internal surface 30 of the third front wall 12 with the pillar 22 has a continuous curved surface 23 ensuring a progressive rotation of the liquid following arrow $F_3$. The turbulences in the cooling liquid then arriving in the heat exchange space 16 are reduced and the liquid may calmly bypass the injectors occupying a significant volume in the heat exchange space 16. In this example, the calories accumulated in the front wall 12 exposed to the molten liquid bath are transferred to the pillar 22 whose surface of contact with the cooling liquid is increased thanks to its thinned part I, which improves the metal/liquid thermal transfer.

Furthermore, the pillar 22 advantageously has a second part II of predetermined length L2 connecting said thinned part I and said first end E1, said second part II having a circular transversal section defined by a predetermined diameter D2, constant along the length L2, such that the ratio $D2/D_{ext}$ is advantageously between 10% and 15%.

In fact, the pillar 22 being formed of a material of good thermal conductivity, the heat rising from the bath and transferring to the third front wall 12 and its central area 14 where it may then be led by the pillar 22 towards the cooling liquid. The latter moving around the pillar 22 ensures constant catchment of the heat of the third front wall 12. In order to optimise this, the parts most exposed to the bath, namely the third front wall 12 and the pillar 22, are produced in wrought copper which ensures better thermal conductivity than cast copper.

Advantageously, the first thinned part I is further characterised by a predetermined diameter D1 which gradually changes from diameter D2 at the connection with the second part II to a value preferably between 60% and 80% of D2 at the second end E2 of the pillar 22. The diameter D1 of the thinned part I of the pillar 22 thus progressively reduces as it moves along the longitudinal axis L of the lance tip towards the bath until reaching a minimum value, then called D3 corresponding to the second end E2 of the pillar.

Preferably, the continuous curved surface 23 between the thinned part I of the pillar 22 and the tapered central area 14 of the internal surface 30 of the third front wall 12 is characterised by a radius of curvature greater than or equal to 30% of diameter D2 in the second part II of the pillar 22.

In the embodiment presented in FIG. 4, the separator 7 and the thinned part I of the pillar 22 facing each other have a positive fit, thus ensuring the most delicate accompaniment of the cooling liquid possible. In fact, the edge 18 of the separator 7 and the thinned part I of the pillar 22 allow a path to be formed for the cooling liquid, reducing the turbulences in the liquid.

A deflector 24 may also be placed in the centre of the tube 2 for supplying stirring gas. This deflector 24 allows the gas leaving the central conduit 2 to be appropriately derived for engaging in the injectors 17.

Figure 5:
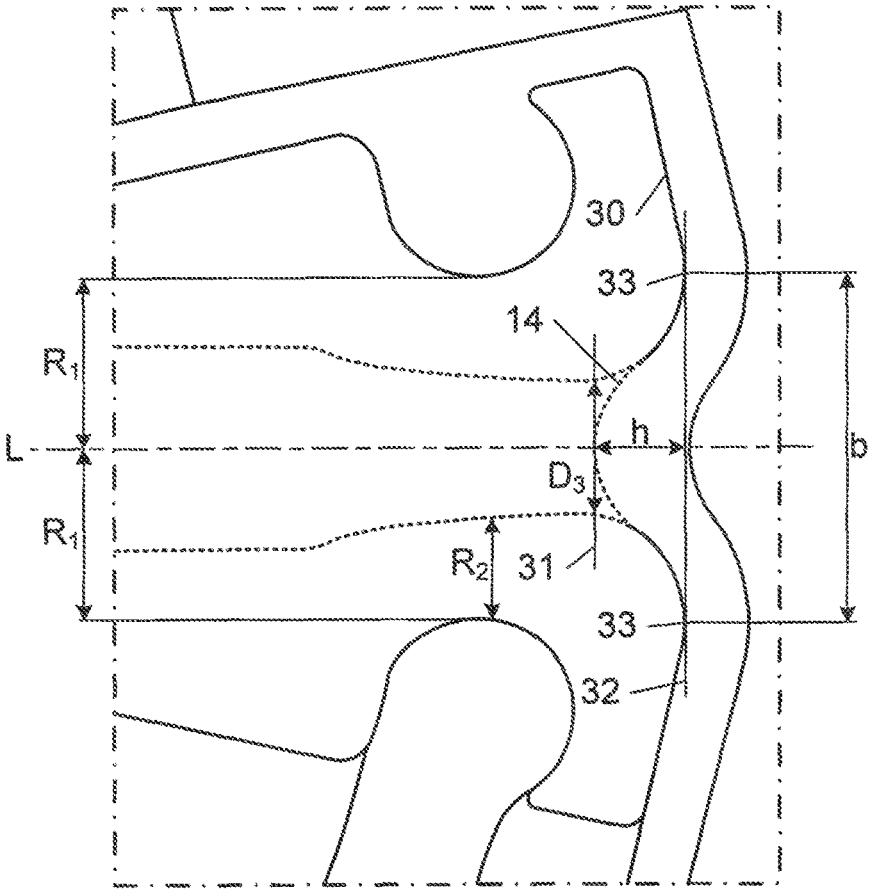
FIG. 5 represents a detail of a lance tip according to the invention, to illustrate the method for measuring the parameters necessary for an advantageous embodiment of the invention.

FIG. 5 represents a detail of the tapered central area 14 in order to clarify the method for measuring the parameters relative to this central area 14 of the internal surface 30 of the third front wall 12. The height h is measured between the plane tangent 32 of the internal wall 30 of the lance tip perpendicular to the longitudinal axis L and the parallel plane 31 tangential to the top of the tapered central area 14. If an additional element in the tapered central area 14 is provided at the top of this, such as, for example, pillar 22, the plane 31 remains in the position that it would adopt if this additional element did not exist. The top of the tapered central area 14 coinciding with the transversal section of the thinned part I of pillar 18 having a minimum diameter D3, the plane 31 also passes by this section of minimum diameter D3 of the pillar 22.

The base b is located in the plane tangent 32 of the internal wall 30. It is contained by the intersection points 33 with the extension of the internal wall 30.

Advantageously, the tip according to the invention has a ratio h/(b-D3) between 50% and 80%. Therefore, in the event where no additional element, such as, for example, a pillar, is present in the central area 14, D3 is zero and the ratio h/b is preferably between 50% and 80%.

FIG. 5 also represents distance R for the cooling liquid passage taken perpendicularly to the longitudinal axis L of the tip in the central opening 8. When no pillar is present in the central opening 8, the distance R is measured between the front 19 of the separator 7 and the longitudinal axis L, this distance for the cooling liquid passage is then labelled $R_1$ and corresponds to the minimum radius of the central opening 8. When a pillar 22 is present in the central opening, the liquid passage distance R is then measured between the separator 7 front 19 and the external surface of the thinned part I of pillar 22, the distance is then labelled $R_2$. In these two scenarios, this distance for the cooling liquid passage is such that the ratio R/H3 is preferably between 70% and 110%, with R corresponding to R1 in the absence of a pillar or corresponding to R2 in the presence of a pillar.

It is understood that the present invention is in no way limited to the embodiments described above and that modifications may be applied without leaving the scope of the appended claims.

The invention claimed is:

1. A blowing lance tip for bath stirring, comprising:

a central tube configured for supplying stirring gas, closed at a bath end by a first front wall provided with at least two openings;

an internal tube forming with the central tube a first annular cavity for flowing a cooling liquid and ended at the bath end by a second front wall, having a central opening and one passage orifice per opening provided in said first front wall;

an external tube forming with the internal tube a second annular cavity for flowing the cooling liquid and closed at the bath end by a third front wall having one outlet orifice per opening provided in said first front wall and having an internal surface comprising a tapered central area which is directed towards said central opening and which has a curved enveloped surface in an axial section;

a heat exchange space located between a) said second front wall and said third front wall and b) said central opening and said second annular cavity, and in which the cooling liquid flows; and an injector leaving each opening in said first front wall and extending to said corresponding outlet orifice passing through said corresponding passage orifice in a cooling liquid-tight manner, wherein said second front wall has an edge in an axial section at the central opening which is curved such that a height (H3) is defined between a front of said edge and said third front wall, wherein in the heat exchange space a minimum predetermined height (H1) is present on a side of said central opening, such that a ratio H1/H3 is between 5% and 80% and wherein said second front wall has a surface turned towards the bath end which is substantially sinusoidal, said heat exchange space having a maximum height Hmax between a central area of the second front wall and the third front wall.

2. The blowing lance tip according to claim 1, wherein a distance R is perpendicular to a longitudinal axis L of the blowing lance tip between said front of the edge of the second front wall and the longitudinal axis L, said distance R being such that a ratio R/H3 is between 20% and 150%.

3. The blowing lance tip of claim 1, wherein the external tube has external surfaces, the blowing lance tip having a predetermined external diameter (Dext) measured between said external surfaces and wherein said edge of the second front wall is defined by a thickness (e1) such that a ratio e1/Dext is between 5% and 30%.

4. The blowing lance tip of claim 1, further comprising a pillar comprising a first end (E1) linked to a central area of an external surface of the first front wall and a bath end (E2) linked to the central area of the internal surface of the third front wall.

5. The blowing lance tip of claim 4, wherein the pillar has a thinned part (I) between said first and second ends (E1 and E2) linked to the central area, which has a predetermined length L1 and an axial section decreasing in such a way that the pillar forms a continuous curved section with the central area of the internal surface of the third front wall.

6. The blowing lance tip of claim 5, wherein said thinned part I of the pillar has a minimum predetermined diameter D3 at said second end (E2) and said central area of the internal surface of the third front wall has a height h and a base b so a ratio h/(b-D3) is between 20% and 120.

7. The blowing lance tip of claim 1, wherein a deflector is substantially centered in central stirring gas supply tube.

8. The blowing lance tip of claim 1, wherein the injector has a revolution axis (m) oriented obliquely with respect to a longitudinal axis (L) of the blowing lance tip.

9. The blowing lance tip according to claim 1, wherein the ratio H1/H3 is between 5% and 75%, 5% and 70%, 5% and 65%, 5% and 60%, 10% and 60%, 15% and 60%, 20% and 60%, 25 and 60%, between 25% and 55%, or 30% and 55%.

10. The blowing lance tip according to claim 1, wherein the ratio H1/H3 is between a range between 30% and 55%.

11. The blowing lance tip according to claim 2, wherein the ratio R/H3 is between 30% and 140%, 30% and 130%, 40% and 130%, 50% and 130%, 60% and 120%, 60% and 110%, or 70% and 110%.

12. The blowing lance tip according to claim 2, wherein said distance R being such that a ratio R/H3 is between a range of 70% and 110%.

13. The blowing lance tip according to claim 3, wherein the ratio e1/Dext is between 7% and 25%, 7% and 20%, or 7% and 15%.

14. The blowing lance tip according to claim 3, wherein the ratio e1/Dext is a between 7% and 15%.

15. The blowing lance tip of claim 6, wherein the ratio h/(b-D3) is between 20% and 110%, 30% and 110%, 30% and 100%, 40% and 100%, 40% and 90%, 45% and 85%, or 50% and 80%.

16. The blowing lance tip of claim 6, wherein the ratio h/(b-D3) is between a range of 50% and 80%.

* * * * *